US009548020B2

(12) United States Patent
Kim et al.

(10) Patent No.: US 9,548,020 B2
(45) Date of Patent: Jan. 17, 2017

(54) ORGANIC LIGHT-EMITTING DISPLAY DEVICE TO COMPENSATE PIXEL THRESHOLD VOLTAGE

(71) Applicant: LG Display Co., Ltd., Chicago, IL (US)

(72) Inventors: Jin Hyoung Kim, Goyang-si (KR); Seung Tae Kim, Goyang-si (KR); Kyoung Sik Choi, Daejeon (KR); Ui Jeong, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 13/649,230

(22) Filed: Oct. 11, 2012

(65) Prior Publication Data

US 2013/0093652 A1 Apr. 18, 2013

(30) Foreign Application Priority Data

Oct. 12, 2011 (KR) ..... 10-2011-0104184

(51) Int. Cl.
*G09G 3/30* (2006.01)
*G09G 3/32* (2016.01)

(52) U.S. Cl.
CPC ..... *G09G 3/3233* (2013.01); *G09G 3/3208* (2013.01); *G09G 3/3266* (2013.01); *G09G 2300/0814* (2013.01); *G09G 2300/0819* (2013.01); *G09G 2320/045* (2013.01)

(58) Field of Classification Search
CPC ..... G09G 3/30; G09G 3/3208; G09G 3/3233; G09G 2320/045
USPC ..... 345/76, 82
See application file for complete search history.

(56) References Cited

U.S. PATENT DOCUMENTS

| | | | | |
|---|---|---|---|---|
| 6,977,470 | B2 * | 12/2005 | Tseng | 315/169.3 |
| 7,345,660 | B2 * | 3/2008 | Mizukoshi et al. | 345/77 |
| 7,535,442 | B2 | 5/2009 | Yamashita et al. | |
| 7,884,786 | B2 * | 2/2011 | Kim et al. | 345/83 |
| 7,932,877 | B2 * | 4/2011 | Tanada et al. | 345/76 |
| 8,115,707 | B2 * | 2/2012 | Nathan et al. | 345/78 |
| 8,427,397 | B2 * | 4/2013 | Kwon et al. | 345/46 |

(Continued)

FOREIGN PATENT DOCUMENTS

| | | |
|---|---|---|
| CN | 101859536 A | 10/2010 |
| CN | 201010530854 | 10/2010 |

(Continued)

OTHER PUBLICATIONS

Kanicki et al, "100 dpi 4-a-Si:H TFTs Active-Matrix Organic Polymer Light-Emitting Display", IEEE Journal of Selected Topics in Quantum Electronics, vol. 10, No. 1, 2004, p. 16-25.*

(Continued)

*Primary Examiner* — Chanh Nguyen
*Assistant Examiner* — Yuzhen Shen
(74) *Attorney, Agent, or Firm* — Brinks Gilson & Lione

(57) ABSTRACT

An organic light-emitting display device includes: an organic light-emitting panel comprising a plurality of pixel regions, each pixel region comprising a scan line and a data line crossing each other, each pixel region further comprising an organic light-emission element and a drive transistor configured to drive the organic light emission element; and a circuit configured to sense a threshold voltage of the drive transistor in a sensing interval and control a light emission of the organic light emission element within the pixel region in a display interval.

12 Claims, 10 Drawing Sheets

(56) References Cited

U.S. PATENT DOCUMENTS

| | | | | |
|---|---|---|---|---|
| 8,791,887 | B2 * | 7/2014 | Smith et al. | 345/78 |
| 8,836,691 | B2 * | 9/2014 | Ryu et al. | 345/214 |
| 2005/0156837 | A1 * | 7/2005 | Kasai | G09G 3/3275 345/77 |
| 2008/0074413 | A1 * | 3/2008 | Ogura | G09G 3/3233 345/212 |
| 2008/0191976 | A1 * | 8/2008 | Nathan et al. | 345/76 |
| 2008/0303754 | A1 * | 12/2008 | Murata et al. | 345/76 |
| 2009/0140959 | A1 * | 6/2009 | Nam et al. | 345/76 |
| 2011/0122119 | A1 * | 5/2011 | Bae et al. | 345/211 |
| 2011/0157134 | A1 * | 6/2011 | Ogura | G09G 3/20 345/211 |
| 2011/0205250 | A1 * | 8/2011 | Yoo et al. | 345/690 |
| 2011/0216056 | A1 * | 9/2011 | Yoo et al. | 345/212 |
| 2012/0019569 | A1 * | 1/2012 | Byun | 345/690 |
| 2013/0099692 | A1 * | 4/2013 | Chaji et al. | 315/224 |
| 2013/0155038 | A1 * | 6/2013 | Yamashita | G09G 3/3233 345/204 |

FOREIGN PATENT DOCUMENTS

| | | | |
|---|---|---|---|
| CN | 102074189 | A | 5/2011 |
| CN | 102163402 | A | 8/2011 |
| DE | 102010061736 | A1 | 6/2011 |
| KR | 1020110061772 | A | 6/2011 |
| KR | 20120045252 | A | 5/2012 |
| KR | 20130036661 | A | 4/2013 |
| KR | 20130037081 | A | 4/2013 |

OTHER PUBLICATIONS

Office Action issued in Chinese Patent Application No. 201210384765.0, mailed Jun. 24, 2014, 20 pages.

Office Action issued in German Patent Application No. 102012109738.0, mailed May 13, 2014, 16 pages.

Office Action issued in corresponding Korean Patent Application No. 10-2011-0104184, mailed Feb. 28, 2014, 4 pages.

Office Action issued in Korean Patent Application No. 10-2011-0104184, mailed Sep. 30, 2014, 6 pages.

* cited by examiner

ORGANIC LIGHT-EMITTING DISPLAY DEVICE TO COMPENSATE PIXEL THRESHOLD VOLTAGE

The present application claims priority under 35 U.S.C. §119(a) of Korean Patent Application No. 10-2011-0104184 filed on Oct. 12, 2011, which is hereby incorporated by reference in its entirety.

BACKGROUND

Field of the Invention

Devices for displaying information are being widely developed. The display devices include liquid crystal display (LCD) devices, organic light-emitting display (OLED) devices, electrophoresis display devices, field emission display (FED) devices, and plasma display devices.

Discussion of the Related Art

Among these display devices, OLED devices have the features of lower power consumption, wider viewing angle, lighter weight and higher brightness compared to LCD devices. As such, the OLED device is considered to be next generation display devices.

Thin film transistors used in the organic light-emitting display device can be driven in high speed. To this end, the thin film transistors increase carrier mobility using a semiconductor layer, which is formed from polysilicon. Polysilicon can be derived from amorphous silicon through a crystallizing process.

A laser scanning mode is widely used in the crystallizing process. During such a crystallizing process, the power of a laser beam can be unstable. As such, the thin film transistors formed on the scanned line, which is scanned by the laser beam, can have different threshold voltages from each other. This can cause image quality to be non-uniform between pixel regions.

To address this matter, a technology detecting the threshold voltages of pixel regions and compensating for the threshold voltages of thin film transistors had been proposed.

However, in order to realize such threshold voltage compensation, not only a transistor for detecting the threshold voltage must be added into the pixel region but also signal lines used for controlling the thin film transistors must be added. Due to this, the pixel region becomes complex, and furthermore an aperture of the pixel region decreases.

BRIEF SUMMARY

According to a general aspect of the present embodiment, an organic light-emitting display device includes: an organic light-emitting panel comprising a plurality of pixel regions, each pixel region comprising a scan line and a data line crossing each other, each pixel region further comprising an organic light-emission element and a drive transistor configured to drive the organic light emission element; and a circuit configured to sense a threshold voltage of the drive transistor in a sensing interval and control a light emission of the organic light emission element within the pixel region in a display interval.

According to a general aspect of the present embodiment, in a method for operating an organic light-emitting display device, the organic light-emitting display device may include: an organic light-emitting panel including a plurality of pixel regions, each pixel region including a scan line and a data line crossing each other, each pixel region further including an organic light-emission element and a drive transistor configured to drive the organic light emission element. The method may include: sensing a threshold voltage of the drive transistor in a sensing interval, and controlling a light emission of the organic light emission element within the pixel region in a display interval.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE DRAWINGS AND THE PRESENTLY PREFERRED EMBODIMENTS

Figure 1:
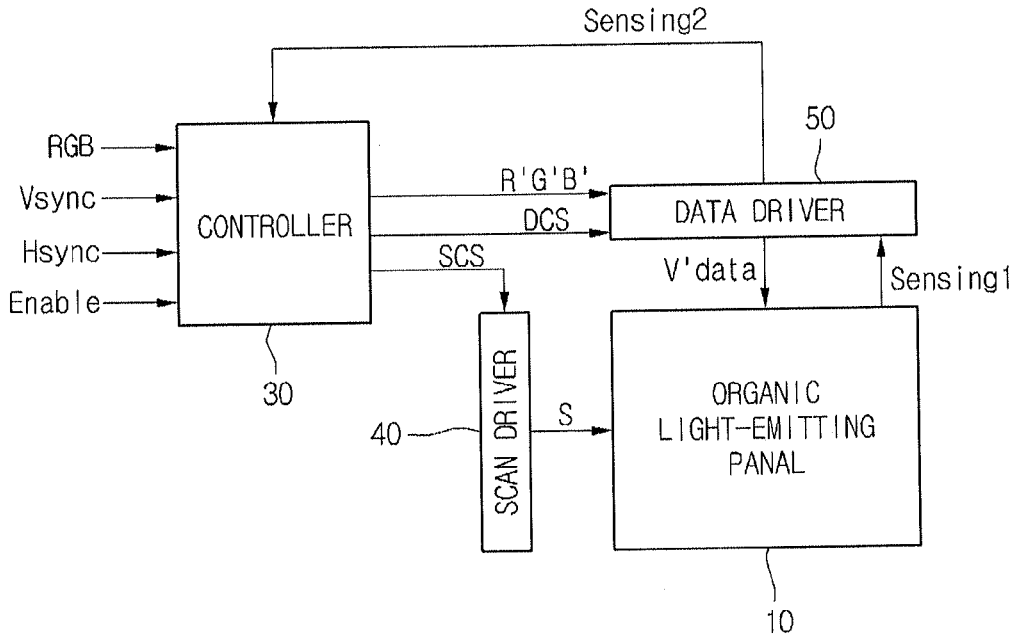
FIG. 1 is a block diagram showing an organic light-emitting display device according to an embodiment of the present disclosure.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 1 is a block diagram showing an organic light-emitting display device according to an embodiment of the present disclosure.

Referring to FIG. 1, the organic light-emitting display device according to an embodiment of the present disclosure can include an organic light-emitting panel 10, a controller 30, a scan driver 40 and a data driver 50.

The scan driver 40 can apply a scan signal including first and second scan signals S to the organic light-emitting panel 10.

The data driver 50 can apply data voltages V'data to the organic light-emitting panel 10.

Figure 2:
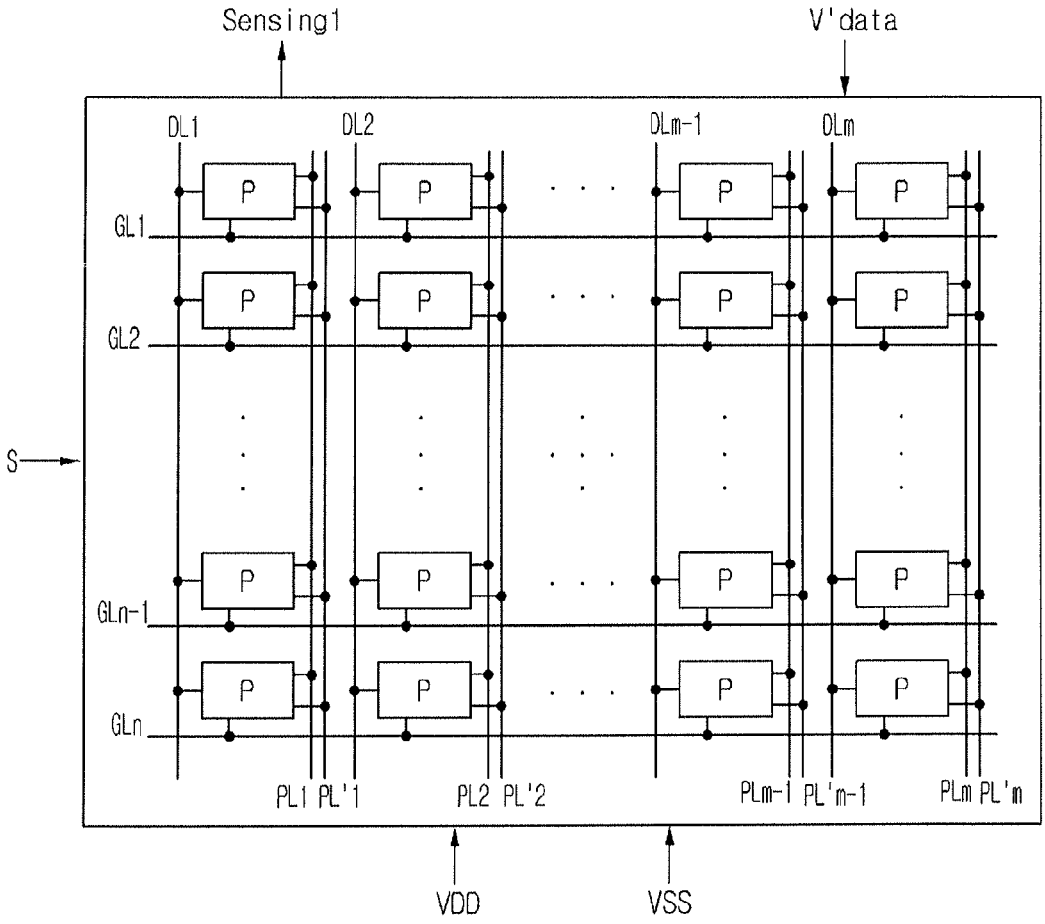
FIG. 2 is a circuit diagram showing an organic light-emitting panel of FIG. 1.

The organic light-emitting panel 10 can include a plurality of scan lines GL1~GLn, a plurality of data lines DL1~DLm, a plurality of first power lines PL1 through PLm and a plurality of second power lines PL'1 through PL'm, as shown in FIG. 2.

Although it is not shown in the drawings, the organic light-emitting panel 10 can further include a plurality of signal lines.

A plurality of pixel regions P can be defined by the scan lines GL1 through GLn and data lines DL1 through DLm which are crossed with each other. These pixel regions P can be arranged in a matrix shape. Each of the pixel regions P can be electrically connected to the scan line GL1 through GLn, the data line DL1 through DLm, the first power line PL1 through PLm, and the second power line PL'1 through PL'm.

For example, the scan line GL1 through GLn can be electrically connected to the plurality of pixel regions P in a horizontal direction. The data line DL1 through DLm can be electrically connected to the plurality of pixel regions P in a vertical direction.

Such a pixel region P can receive a scan signal S, a data voltage V'data and first and second power supply voltages VDD and VSS. More specifically, the scan signal S can be applied to the pixel region P through the scan line GL1 through GLn, and the data voltage V'data can be applied to the pixel region P via the data line DL1 through DLm. Also, the first and second power supply voltages VDD and VSS can be applied to the pixel region P each through the first and second power supply lines PL1~PLm and PL'1~PL'm.

Meanwhile, sensing information Sensing1 including a threshold voltage Vth of the pixel region can be obtained from the pixel region P. The sensing information Sensing1 may be applied from the pixel region P to the exterior, for example the data driver 50 of FIG. 1, through the data line DL1~DLm, or to an individual sensing controller separate from the data driver 50.

First through third transistors T1~T3, a storage capacitor Cst, a load capacitor Cload, and an organic light emission element OLED can be formed in each of the pixel regions P, but it is not limited to this. In other words, the number of transistors and a connection structure therebetween within each of the pixel regions can be modified in a variety of shapes by a designer. As such, this embodiment can be applied to every circuit structure of the pixel region, which can be modified by designers.

The first and second transistors T1 and T2 can be switching transistors used to transfer signals. The third transistor T3 can be a drive transistor used to generate a drive current for driving the organic light emission element OLED.

The storage capacitor Cst can function to maintain the data voltage Vdata for one frame period.

The load capacitor Cload can charge a pre-charge data voltage Vpre applied from the exterior and apply the charged pre-charge data voltage Vpre to the organic light emission element OLED. Also, the load capacitor Cload can provide the sensing information Sensing1, which includes the threshold voltage Vth of the third transistor T3 and the mobility μ, to the exterior.

The organic light emission element OLED emits light. The organic light emission element OLED can emit light having brightness varying with intensity of the drive current. Such an organic light emission element OLED can include a red organic light emission element OLED configured to emit red light, a green organic light emission element OLED configured to emit green light, and a blue organic light emission element OLED configured to emit blue light.

The first through third transistors T1~T3 can be PMOS-type thin film transistors, but it is not limited to this. The first through third transistors T1~T3 can be turned-on by a low level signal and turned-off by a high level signal.

The high level can become a ground voltage or a voltage approaching the ground voltage. The low level can become a lower voltage than the ground voltage. For example, the low and high levels can be −10V and 0V, respectively, but it is not limited to this.

The first power supply voltage VDD can be a high level signal. The second power supply voltage VSS can be a low level signal. The first and second power supply voltages VDD and VSS can be DC (Direct Current) voltages maintaining fixed levels, respectively.

Figure 3:
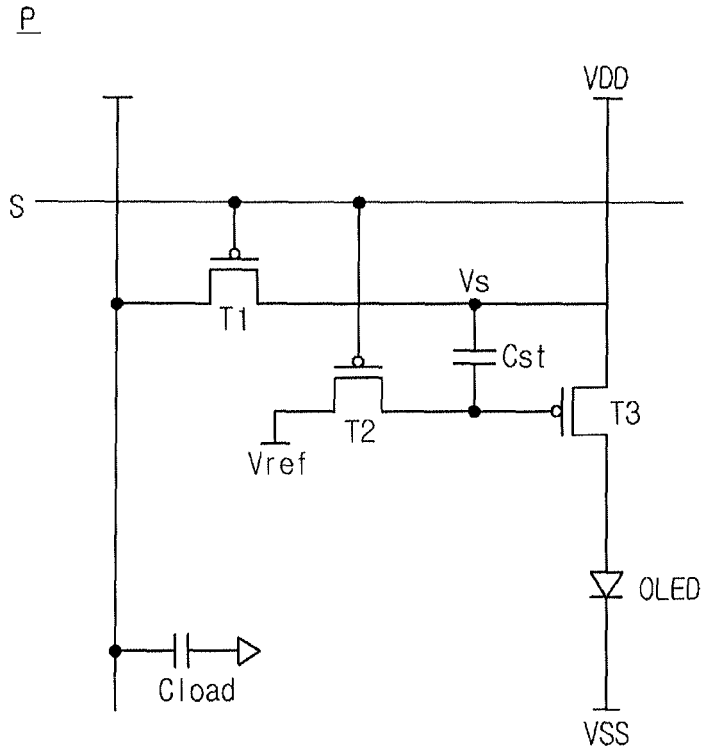
FIG. 3 is a circuit diagram showing a pixel region in FIG. 2.

In FIG. 3, the scan line GL is disclosed. Also, FIG. 3 shows that a scan signal S is applied to the scan line GL.

However, the scan signal S is generated in substantially same waveform. As such, the same scan signal can be applied to the first and second transistors T1 and T2. In accordance therewith, the scan line GL can be formed in a single line shape and a single scan signal can be transferred through the single scan line. In alternative embodiments, two scan lines may be provided.

The load capacitor Cload can be connected to the data line DL. As such, the load capacitor Cload can charge the pre-charge data voltage Vpre and the data voltage which are applied from the data line DL. Additionally, the load capacitor Cload can charge the sensing information Sensing1 including the threshold voltage Vth when the sensing information Sensing1 is detected. The sensing information Sensing1 charged in the load capacitor Cload can be provided to the exterior through the data line DL. In alternative embodiments, the sensing information Sensing1 may be charged into an additional capacitor which may be connected to an additional sensing line.

A gate electrode of the first transistor T1 can be connected to the scan line GL to which the scan signal S is applied. A source electrode of the first transistor T1 can be connected to the data line DL. A drain electrode of the first transistor T1 can be connected to a first node.

Such a first transistor T1 can be turned-on by the scan signal S of a low level, which is applied to the scan line GL, and enable the data voltage V'data, which is used for display an image, on the data line DL to be charged into the first node.

The first node can be commonly connected to the drain electrode of the first transistor T1, the storage capacitor Cst, a source electrode of the third transistor T3, and the first power line PL.

A gate electrode of the second transistor T2 can be connected to the scan line GL to which the scan signal S is applied. A source electrode of the second transistor T2 can be connected to the reference line to which a reference voltage Vref is applied. A drain electrode of the second transistor T2 can be connected to a second node.

Such a second transistor T2 can be turned-on by the scan signal S of the low level, which is applied to the scan line GL, and enable the second node to be discharged to the reference voltage.

The second node can be commonly connected to the drain electrode of the second transistor T2 and a gate electrode of the third transistor T3.

The storage capacitor Cst can be connected between the first node and the second node. The storage capacitor Cst can enable the voltage at the second node to be varied with voltage variation of the first node.

The gate electrode of the third transistor T3 can be connected to the second node. The source electrode of the third transistor T3 can be connected to the first power line PL.

The third transistor T3 can generate a drive current varying with the voltage on the second node. Also, the third transistor T3 can apply the drive current to the organic light emission element OLED.

The organic light emission element OLED can emit light by the drive current from the third transistor T3.

Although it is not shown in FIG. 3, another transistor being switched by a light emission signal can be disposed between the first power line PL and the third transistor T3.

Figure 4:
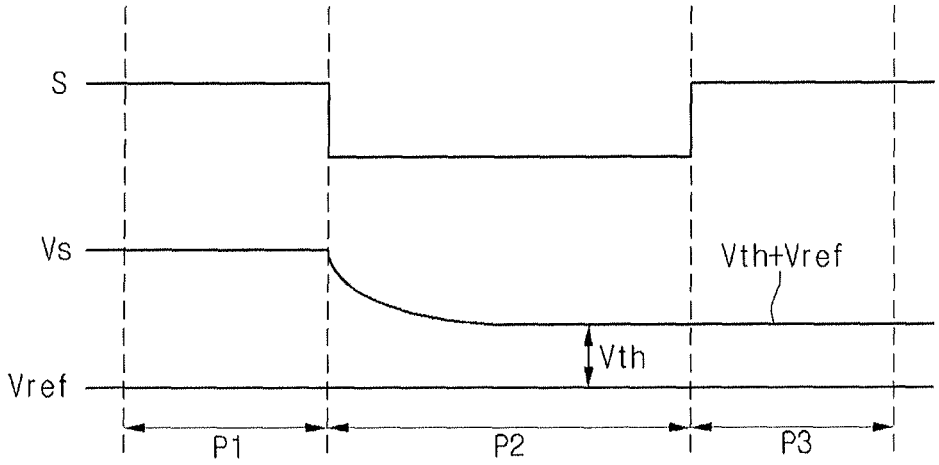
FIG. 4 is a waveform diagram illustrating signals used for detecting a sensing voltage.

Such a circuit configuration of the pixel region shown in FIG. 3 can be driven by signals with waveforms shown in FIG. 4.

As shown in FIG. 4, the circuit configuration within the pixel region can be driven according to three individual intervals.

A first interval P1 is a period used to charge the data voltage V'data into the load capacitor Cload. A second interval P2 corresponds to another period used to either sense the threshold voltage of the third transistor T3, that is a drive transistor, or drive the organic light emission diode OLED. A third interval P3 is still another period used to apply the sensed threshold voltage to the exterior.

The operation of the circuit configuration of the pixel region will now be described in detail in each of the first through third intervals referring to FIGS. 5A through 5D.

<First Interval>

Figure 5A:
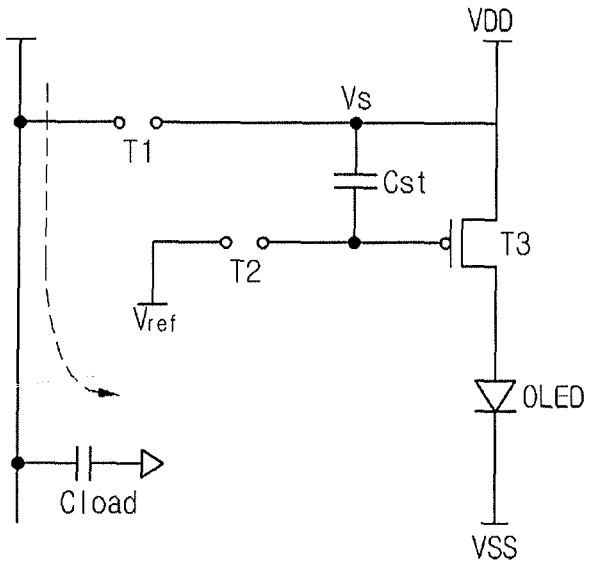
FIGS. 5A through 5C are circuit diagrams showing switching states of transistors when the pixel region is driven in time intervals.

As shown in FIG. 5A, the scan signal S with a high level can be applied to the scan line GL in the first interval P1.

As such, the first and second transistor T1 and T2 can be turned-off by the scan signal S having the high level. Also, the data voltage V'data can be charged into the load capacitor Cload during the first interval P1. At this time, the source voltage on the first node can maintain the previous data voltage, which is charged in a previous frame.

<Second Interval>

Figure 5B:
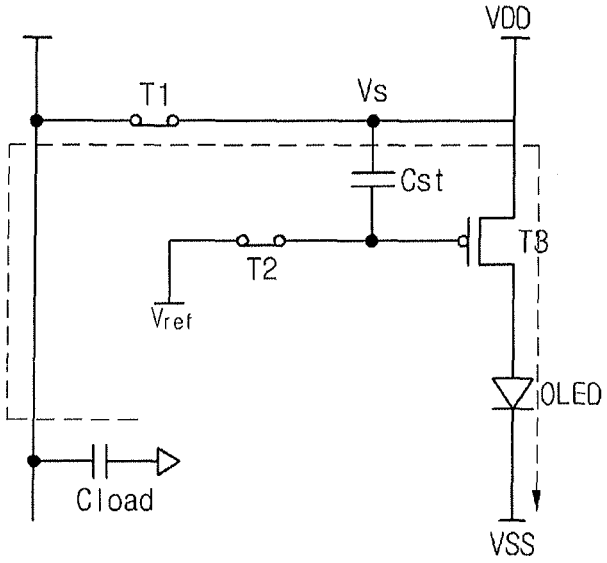

In the second interval P2, the scan signal S having a low level can be applied to the scan line GL, as shown in FIG. 5B.

The scan signal S with the low level can enable the first and second transistors T1 and T2 to be turned-on. As such, the data voltage V'data charged into the load capacitor Cload can be charged into the first node through the first transistor T1, and the reference voltage Vref can be charged into the second node through the second transistor T2. In accordance therewith, a drive current can be applied from the third transistor T3 to the organic light emission element OLED, and allow the organic light emission diode OLED to emit light.

During the second interval P2, the voltage Vs on the first node can be discharged as a threshold voltage of the third transistor T3. The threshold voltage Vth can be charged into the load capacitor Cload through the first transistor T1. In other words, the threshold voltage Vth of the third transistor T3 can be sensed during the second interval P2.

Meanwhile, the organic light emission element OLED can emit light until the voltage Vs on the first node becomes the threshold voltage Vth of the third transistor T3. In various embodiments, at least one of the first transistor T1 and the second transistor T2 remain turned-on until the threshold voltage Vth of the third transistor T3 is reached.

<Third Interval>

Figure 5C:
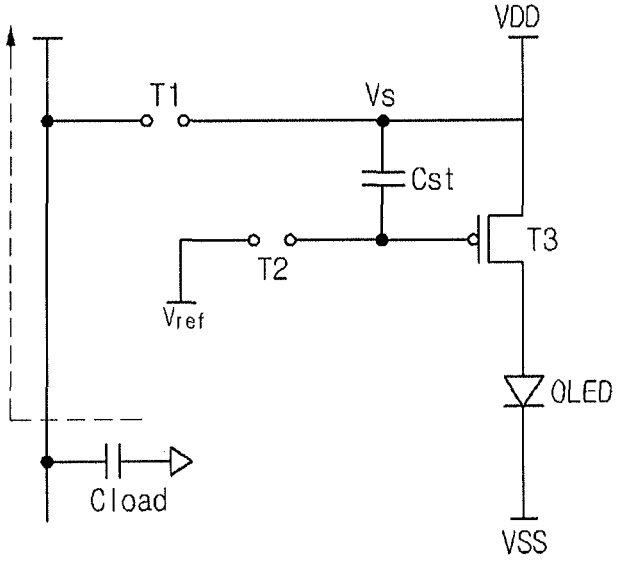

As shown in FIG. 5C, the scan signal S with the high level can be applied to the scan line GL in the third interval P3.

The scan signal S with the high level can force the first and second transistors T1 and T2 to be turned-off. Also, in the third interval P3, the threshold voltage Vth charged into the load capacitor Cload can be applied to the exterior, i.e., a selector 54 shown in FIG. 8, through the data line DL as sensing information.

In the embodiment, such first through third intervals P1 through P3 can allow the sensing information including the threshold voltage Vth to be provided to the exterior.

Figure 6:
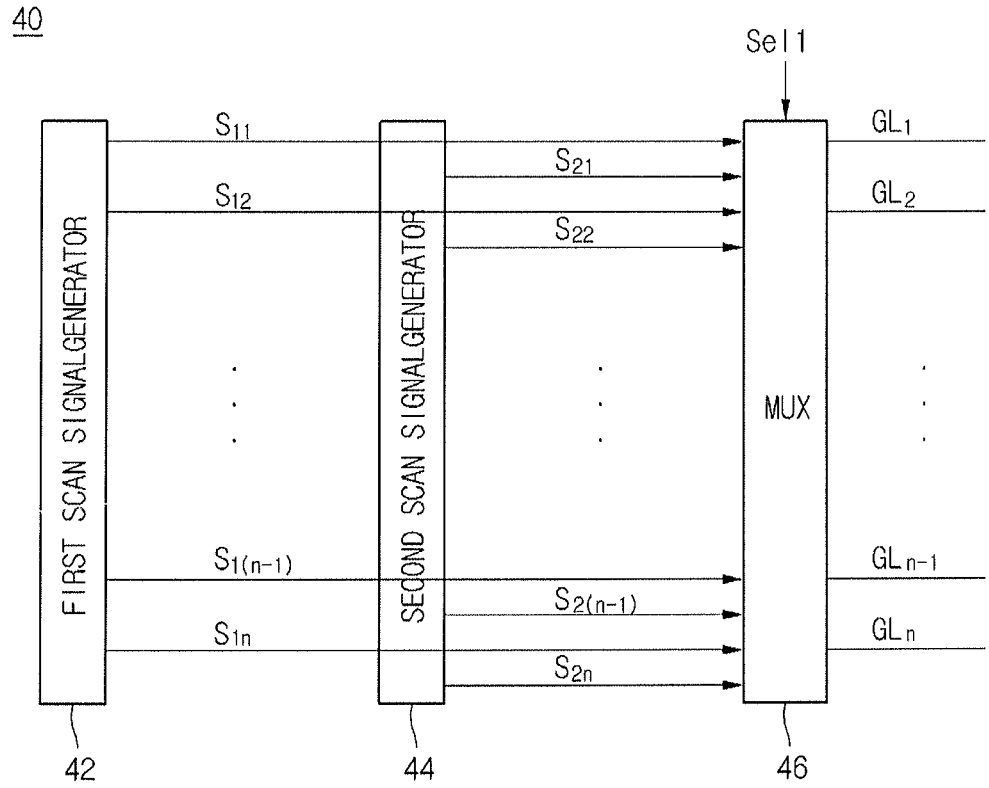
FIG. 6 is a block diagram showing a scan driver of FIG. 1.

As shown in FIG. 6, the scan driver 40 can include a first scan signal generator 42, a second scan signal generator 44 and a multiplexer 46.

The first scan signal generator 42 can generate a first scan signal for a sensing interval in each frame. The first scan signal can be applied to any one of the plural scan lines GL1~GLn.

The second scan signal generator 44 can generate second scan signals for a display interval in each frame. The second scan signals are sequentially applied to the scan lines GL1~GLn on the organic light-emitting panel 10.

A single frame can be defined into the sensing interval and the display interval. The sensing interval can correspond to a vertical blank period of a vertical synchronous signal Vsync, but it is not limited to this. The display interval can also correspond to a period between the vertical blank periods of the vertical synchronous signal Vsync, but it is not limited to this.

The sensing interval and the display interval may be varied according to a brightness resolution of the organic light emitting panel.

For instance, if the organic light emitting panel have FHD (full high definiton) in a frequency of 120 hz, the sensing interval include about 400 μs, and the display interval includes about 8 ms.

Figure 7:
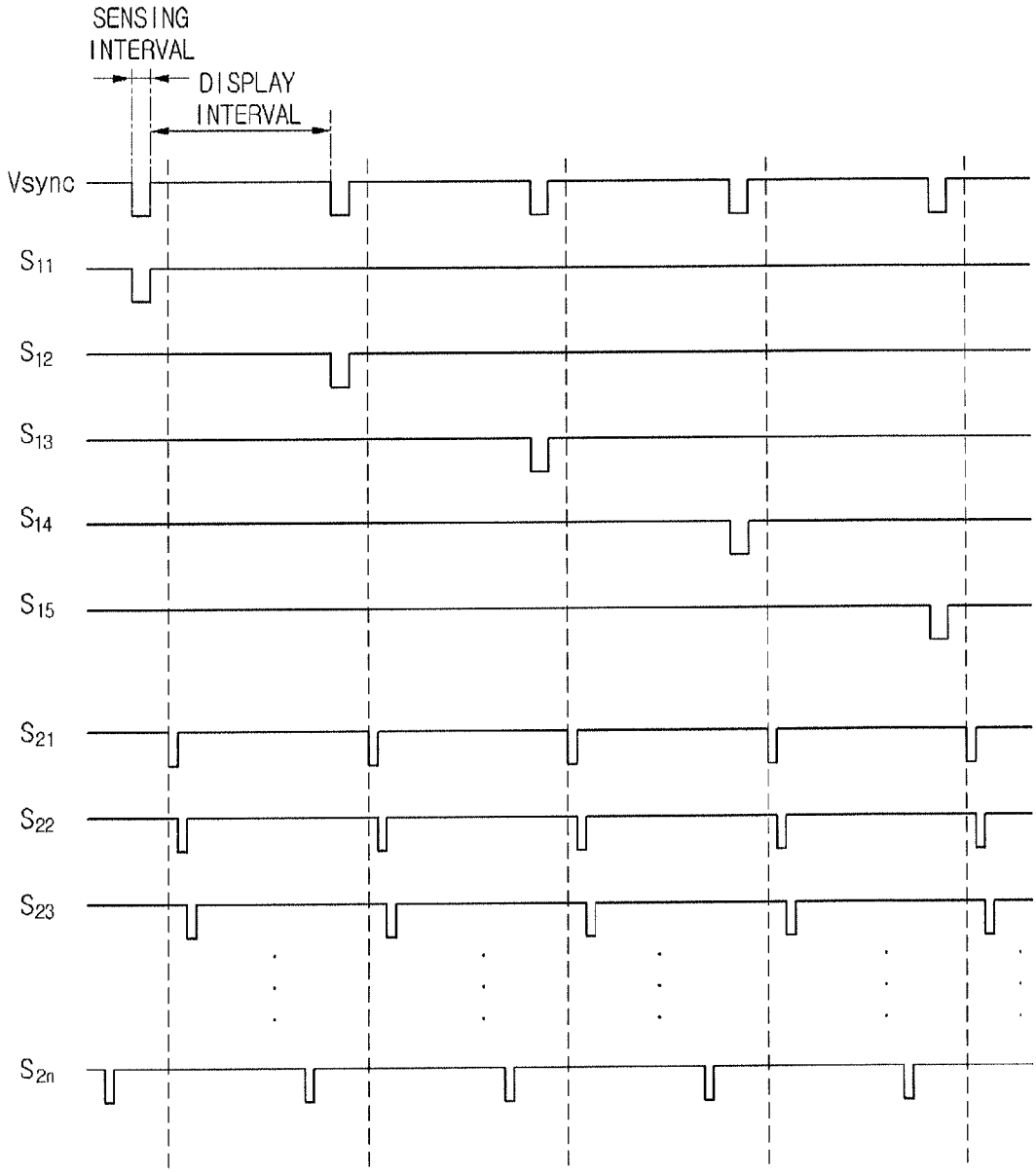
FIG. 7 is a waveform diagram illustrating signals, which are used for driving the scan driver of FIG. 1.

As such, the first scan signal can be generated by only one in each frame, as shown in FIG. 7. The first scan signal can be applied to any one of the plural scan lines GL1~GLn on the organic light-emitting panel 10 in each frame.

The second scan signals can be generated by the number of the scan lines within the organic light-emitting panel 10 and sequentially applied to the scan lines GL1~GLn, in each frame. In this case, the second scan signal can correspond to a pulse width of a horizontal synchronous signal, but it is not limited to this.

For example, the first scan signal can be generated and applied to the first scan line GL1 of the organic light-emitting panel 10, in the vertical blank period of the vertical synchronous signal Vsync within a single frame. As such, the threshold voltages Vth of the third transistors T3, i.e., the drive transistors can be sensed in the pixel regions connected to the first scan line GL1, respectively. Also, in the vertical blank period of the vertical synchronous signal within the next frame, the first scan signal can be generated and applied to the second scan line GL2 of the organic light-emitting panel 10. Therefore, the first scan signal being generated one time every frame can be applied to the scan lines GL1~GLn during the period of frames corresponding to the number of scan lines GL1~GLn.

For a period except the vertical blank period of the vertical synchronous single of each frame, that is the display interval, the second scan signals can be sequentially generated and applied to the scan lines GL1~GLn of the organic light-emitting panel 10. The organic light emission elements OLED within the pixel regions P connected to each of the scan lines GL1~GLn can emit light by the drive currents of the respective drive transistors.

The data voltage V'data can be charged into the load capacitor Cload before the second scan signal is applied. In other words, the data voltage V'data can be charged into the load capacitor Cload in the first interval P1 of FIG. 4.

Alternatively, the data voltage V'data can be simultaneously charged into the load capacitor Cload when the second scan signal is applied. In other words, the data voltage V'data can be charged into the second interval P2. At the same time, the third transistor T3 can be driven and the organic light emission element OLED can emit light.

As such, a time point when the data voltage V'data is applied is not limited to the above-mentioned intervals.

For example, if a second scan signal is applied to the first scan line GL1 of the organic light-emitting panel 10, each of the organic light emission elements OLED within the respective pixel regions connected to the first scan line GL1 can emit light.

Another second scan signal delay-generated with a time delay of one horizontal period of the horizontal synchronous signal Hsync can be applied to the second scan line GL2 of the organic light-emitting panel 10. As such, each of the organic light emission elements OLED within the respective pixel regions P connected to the second scan line GL2 can emit light.

In this manner, the second scan signals can be applied to each scan line of the organic light-emitting panel 10 during the display interval.

The multiplexer 46 can selectively output any one of the first scan signal of the first scan signal generator 42 and the second scan signal of the second scan signal generator 44. The multiplexer 46 can be controlled by a first selection signal Sel1.

For example, the first selection signal Sel1 can have a pulse of the low level in the sensing interval corresponding to the vertical blank period. Also, the first selection signal Sel1 can have another pulse of the high level in the display interval. However, the first selection signal Sel1 is not limited to this.

Figure 8:
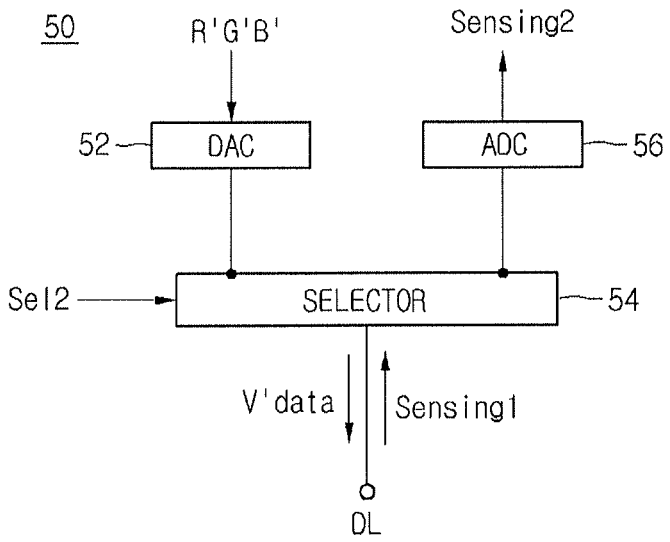
FIG. 8 is a block diagram schematically showing a data driver of FIG. 1.

As shown in FIG. 8, the data driver 50 can include a DAC (Digital-to-Analog Converter) 52, an ADC (Analog-to-Digital Converter) 54, and a selector 54.

The DAC 52 can generate the data voltage V'data. To this end, the DAC 52 can convert a data signal R', G' or B' corresponding to a digital signal into the data voltage V'data of an analog signal.

The ADC 56 can convert the sensing signal Sensing1 of an analog signal obtained from the pixel region P into the sensing information Sensing2 of a digital signal.

The selector 54 can electrically connect the data lines DL1~DLm of the organic light-emitting panel 10 to either the DAC 52 or the ADC 56. The selector 54 can be controlled by a second selection signal Sel1.

For example, the selector 54 can reply to the second selection signal Sel2 having a low level and electrically connect the data lines DL1~DLm to the DAC 52. Also, the selector 54 can reply to the second selection signal Sel2 having a high level and electrically connect the data lines DL1~DLm to the ADC 56.

The data signals R', G' and B' corresponding to the digital signals can be converted into the data voltages V'data corresponding to the analog signals by means of the DAC 52 in the first interval P1 of FIG. 4. Also, the selector 54 can reply to the second selection signal Sel2 with the low level and electrically connect the data lines DL1~DLm to the DAC 52. As such, the data voltages V'data can be applied from the DAC 52 to the respective pixel regions P through the respective data lines DL1~DLm. In accordance therewith, the data voltages V'data can be charged into the load capacitors Cload of the respective pixel regions P.

In the third interval P3 of FIG. 4, the sensing information Sensing1 including analog signals, which are charged into the load capacitors Cload within the respective pixel regions P, can be applied to the selector 54 through the respective data lines DL1~DLm. The selector 54 can reply to the second selection signal Sel2 with the high level and electrically connect the data lines DL1~DLm to the ADC 56. As such, the sensing information Sensing1 including the analog signals can be applied to the ADC 56. Furthermore, the sensing information Sensing1 with the analog signals can be converted into sensing information Sensing2 including digital signals. The converted sensing information Sensing2 including the digital signals can be applied to the controller 30 of FIG. 1.

Although it is not shown in FIG. 7, the data driver 50 can further include a shift register, a sampling circuit, first and second latches and so on, in order to process the data signals R', G' and B' for displaying an image. Furthermore, the data driver 50 can include a buffer for buffering the data voltages V'data corresponding to the analog signals.

Figure 9:
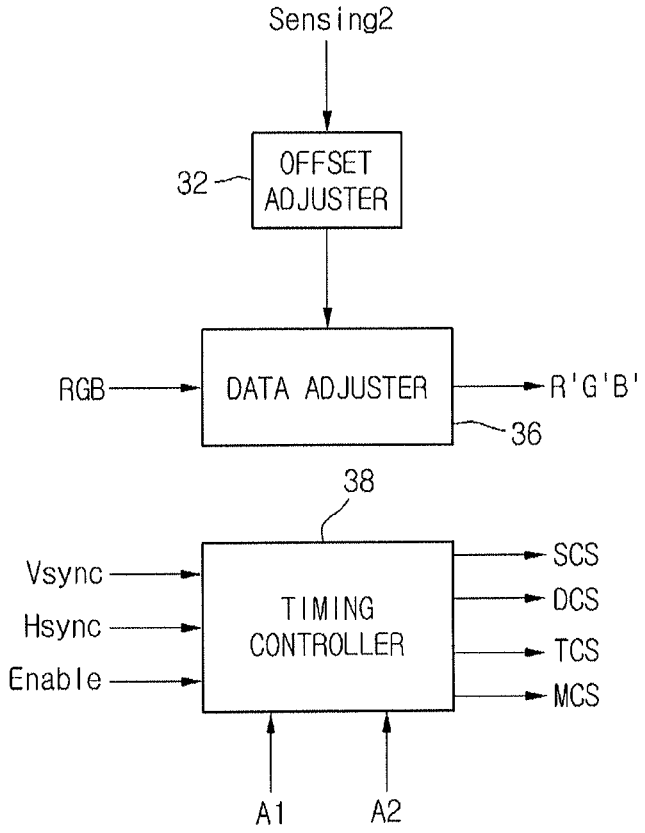
FIG. 9 is a block diagram schematically showing a controller of FIG. 1.

As shown in FIG. 9, the controller 30 can include an offset adjuster 32, a data adjuster 36, and a timing controller 38.

Figure 10:
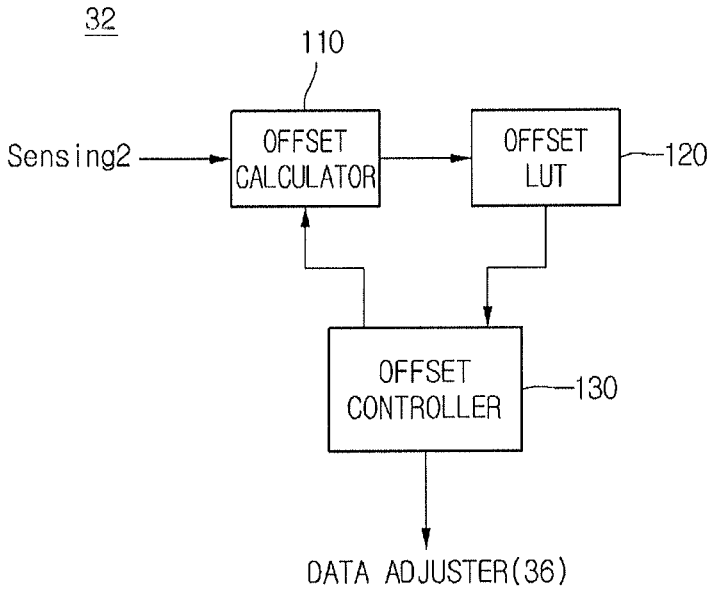
FIG. 10 is a block diagram showing an off-set adjuster of FIG. 9.

The offset adjuster 32 can include an offset calculator 110, an offset LUT (Look-Up table) 120, and an offset controller 130, as shown in FIG. 10.

The offset calculator 110 can receive the sensing information Sensing2 including the threshold voltages Vth which are generated in the organic light-emitting panel 10 and transferred through the data driver 50. Also, the offset calculator 110 can obtain an offset value from the threshold voltage, which is included in the sensing information Sensing2, under control of the offset adjuster 32.

The offset adjuster 110 of an embodiment can directly obtain the offset value from the threshold voltage. Also, the offset calculator 110 can store the obtained offset value in the offset LUT 120.

According to another embodiment, offset information in accordance with a plurality of threshold voltages is stored in a table form in the offset LUT 120. In this case, the offset calculator 110 can read out an offset value corresponding to the threshold voltage Vth, which is included in the sensing information Sensing2, from the offset LUT 120 using the threshold voltage Vth of the sensing information Sensing2.

It is possible that the sensing information Sensing1 generated in each of the pixel regions P within the organic light-emitting panel 10 of FIG. 1 is applied to the offset calculator 110. As such, the offset calculator 110 can calculate the offset values for all the pixel regions P. Also, the calculated offset values can be set out or stored into the offset LUT 120 in such a manner as to correspond to the respective pixel regions P.

The offset value can be used to increase and decrease the data voltage for displaying an image, later. As such, the offset values corresponding to digital signals can are used to separately increase or decrease values of the pixel data signals R', G' and B' so that the pixel data signals R', G' and B' including an image signal are suitably set for the respective pixels.

For convenience of explanation, the offset value can be explained in an analog signal shape. For example, an offset value of 0.5V or another offset value of −0.7 can be added to a data voltage of 5V.

A range of the offset value can be varied along a design specification of a designer, but it is not limited to this.

For example, the offset LUT 120 can store offset values of a single frame.

Referring to FIG. 9, the data adjuster 36 can adjust the image signal R', G' and B on the basis of the offset information which is obtained by the offset adjuster 32.

For example, offset information of a single frame can be applied from the offset adjuster 32 to the data adjuster 36. As such, the data adjuster 36 can reflect the offset information to a first image signal R, G and B and output a second image signal R', G' and B'. The second image signal R', G' and B is applied to the organic light-emitting panel 10 through the data driver 50. As such, an image being compensated for the threshold voltage Vth can be displayed. Thus, non-uniformity of brightness does not generate.

As an embodiment, the offset information can be calculated or updated every frame.

Alternatively, the offset information can be calculated or updated every fixed frame periods. In this case, the fixed frame periods can become one of 5 frame periods, 10 frame periods and 20 frame periods, but it is not limited to these.

Meanwhile, the timing controller 38 can derive timing signals from a vertical synchronous signal Vsync, a horizontal synchronous signal Hsync and an enable signal Enable. The timing signals can be used to drive the organic light-emitting panel 10. Also, the timing signals can include SCS and DCS. The SCS is scan control signals and the DCS is data control signals.

Also, the timing controller 38 can generate and output TCS and MCS using selection signals A1 and A2.

The TCS can become a control signal. The TCS can be used to control not only the sensing information Sensing1 to be obtained from each of pixel regions P but also the offset information to be calculated.

The MCS can also become a control signal. The MCS can be used to control not only the image signal R, G and B to be compensated for the offset information but also an image to be displayed by the compensated image signal R', G' and B'.

In accordance therewith, when the offset information is calculated, all the components within the system can be controlled by the TCS. Also, all the components within the system can be controlled by the MCS when the image is displayed.

Although it is not shown in the drawings, the timing controller 38 can generate the selection signal which is applied to the selector 54 of FIG. 7. However, the timing controller 38 is not limited to this.

The present embodiment does not compensate for the threshold voltage Vth of the pixel region P within the pixel region P. Alternatively, in the present embodiment, the sensing information Sensing1 about the threshold voltage Vth of the drive transistor with the pixel region P is applied to the controller 30, the offset information used to compensate for the threshold voltage Vth is calculated by the controller 30 and reflected into the image signal R, G and B, and an image is display in the organic light-emitting panel 10 by the image signal reflected with the offset information. Therefore, the circuit configuration of the pixel region P can be simplified, and furthermore the aperture ratio of the pixel region P can be maximized.

The present embodiment does not compensate for the threshold voltage of the pixel region within the pixel region. Alternatively, in the present embodiment, the sensing information about the threshold voltage of the drive transistor with the pixel region is applied to the exterior, i.e. the controller, the offset information used to compensate for the threshold voltage is calculated by the controller and reflected into the image signal, and an image is display in the organic light-emitting panel by the image signal reflected with the offset information. In accordance therewith, the circuit configuration of the pixel region can be simplified, and furthermore the aperture ratio of the pixel region can be maximized.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An apparatus comprising:

an organic light-emitting panel having a plurality of pixel regions, each pixel region related with at least one scan line and one data line, each pixel region further comprising:

a first switching transistor having a gate electrode connected to the scan line, a source electrode connected to the data line, and a drain electrode connected to a first node, the first switching transistor configured to transfer a first data voltage from the data line to the first node;

a second switching transistor having a gate electrode connected to the scan line, a source electrode connected to a reference line to which a reference voltage is applied, and a drain electrode connected to a second node, the second switching transistor configured to transfer the reference voltage to the second node;

a drive transistor having a source electrode directly connected to the first node and a gate electrode connected to the second node, the drive transistor configured to drive an organic light-emission element in each pixel region;

a storage capacitor connected to the first node and the second node, configured to maintain the first data voltage during a display interval; and a load capacitor having a first end connected to the data line and a second end connected to a ground terminal, the load capacitor configured to apply a sensing voltage to the data line during a sensing interval, wherein the first node is directly connected to the first switching transistor and the source electrode of the drive transistor and the second node is directly connected to the second switching transistor and the gate electrode of the drive transistor, and wherein the load capacitor charges the sensing voltage through the first switching transistor; and a circuit comprising a data driver configured to apply the first data voltage to each pixel region during a first period of the sensing interval, and to detect the sensing voltage from the load capacitor during a second period of the sensing interval.

2. The apparatus of claim 1, further comprising:

a controller configured to generate a second data signal on the basis of the sensing voltage.

3. The apparatus of claim 2, wherein the data driver includes:

a digital-to-analog converter configured to convert a first data signal from the controller into the first data voltage;

a analog-to-digital converter configured to convert the sensing voltage into a digital sensing signal; and a selector configured to connect the data line to either the digital-to-analog converter or the analog-to-digital converter in response to a selection signal.

4. The apparatus of claim 3, wherein the controller includes:

a offset adjuster configured to generate an offset information based on a threshold voltage included in the digital sensing signal; and a data adjuster configured to reflect the offset information to first data signal to generate a second data signal and output the second data signal to the data driver, the second data signal being converted into a second data voltage by the data driver.

5. The apparatus of claim 1, wherein the data driver is configured to apply the sensing voltage to the controller.

6. The apparatus of claim 1, further comprising:

a scan driver configured to generate a first scan signal and a plurality of second scan signals and to selectively apply the first and second scan signals to the organic light-emitting panel, wherein the scan driver applies the first scan signal to any one of a plurality of scan lines during the sensing interval and the scan driver applies the plurality of second scan signals to the plurality of scan lines during the display interval.

7. The apparatus of claim 6, wherein the first scan signal is generated by one in every frame.

8. The apparatus of claim 6, wherein the second scan signals are sequentially generated by the number of the scan lines in every frame.

9. The apparatus of claim 1, wherein the first and second switching transistors and the drive transistor each includes a PMOS-type thin film transistor.

10. The apparatus of claim 1, wherein the sensing interval includes a vertical blank period of a vertical synchronous signal.

11. The apparatus of claim 1, wherein the display interval includes a period between adjacent vertical blank periods of a vertical synchronous signal.

12. The apparatus of claim 1, further comprising:

a first scan signal generator configured to generate a first scan signal in the sensing interval;

a second scan signal generator configured to generate a plurality of second scan signals in the display interval; and a multiplexer configured to selectively output one of the first scan signal and the plurality of second scan signals.

* * * * *